US007731885B2

(12) United States Patent
Abdo

(10) Patent No.: US 7,731,885 B2
(45) Date of Patent: Jun. 8, 2010

(54) METHOD OF FORMING AND SECURING A ROD GUIDE ON A SUCKER ROD

(75) Inventor: Gary E. Abdo, Edmond, OK (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 114 days.

(21) Appl. No.: 11/977,962

(22) Filed: Oct. 26, 2007

(65) Prior Publication Data

US 2008/0053653 A1 Mar. 6, 2008

Related U.S. Application Data

(62) Division of application No. 11/270,672, filed on Nov. 9, 2005, now abandoned.

(51) Int. Cl.
*B29C 45/14* (2006.01)

(52) U.S. Cl. ..... 264/275; 264/279

(58) Field of Classification Search ..... None
See application file for complete search history.

(56) References Cited

U.S. PATENT DOCUMENTS 2,870,845 A * 1/1959 Tripplehorn ..... 166/176
4,088,185 A * 5/1978 Carson ..... 166/176
5,277,254 A 1/1994 Rullman et al.
5,660,534 A 8/1997 Snow
5,941,312 A 8/1999 Vermeeren
6,065,537 A 5/2000 Evans et al.
6,182,754 B1 * 2/2001 Vermeeren ..... 166/176
6,290,475 B1 9/2001 Snow
6,312,637 B1 * 11/2001 Evans et al. ..... 264/275
6,439,311 B2 8/2002 Haseloh
6,484,882 B1 11/2002 Boretzku et al.

FOREIGN PATENT DOCUMENTS

CA 2260710 4/2000
CA 2260710 2/2001

* cited by examiner

*Primary Examiner*—Edmund H. Lee
(74) *Attorney, Agent, or Firm*—Browning Bushman P.C.

(57) ABSTRACT

A rod guide 10 for positioning on a sucker rod includes a sleeve-shaped guide body 12 and two or more spiraling vanes 14, 16 each extending radially outward from the sleeve-shaped body, with each vane spiraling about the body and defining a flow path between circumferentially spaced vanes. Each vane has a forward portion 24 spiraling in a forward direction, and a backward portion 26 spiraling in a backward direction rotatably opposite the forward direction. The rod guide may be used for either reciprocating rod or rotating rod applications.

14 Claims, 3 Drawing Sheets

METHOD OF FORMING AND SECURING A ROD GUIDE ON A SUCKER ROD

CROSS REFERENCE TO RELATED APPLICATIONS

This application is a divisional of U.S. patent application Ser. No. 11/270,672 filed on Nov. 9, 2005 now abandoned.

FIELD OF THE INVENTION

The present invention relates to rod guides and scrapers supported on a sucker rod for removing debris from the interior wall of production tubing and protecting the tubing and sucker rod couplings from excessive wear. More particularly, the present invention relates to a rod guide or scraper with vanes spiraling along the length of the guide and fluid flow channels between the one or more vanes, and to a method of molding such a rod guide.

BACKGROUND OF THE INVENTION

Various types of rod guides and scrapers have been devised to remove wax, paraffin, and other debris from the interior wall of production tubing. Most rod guides include a sleeve-shaped body for positioning over the sucker rod and one or more vanes projecting radially from the body, with one or more vanes being relatively straight (parallel to the axis of the rod), slanted (inclined at an angle relative to the axis of the rod), or helical (spiraling relative to the axis of the rod). The spacing between the vanes, or between a slanted or spiraling single vane, serves as a flow path for passing production fluid past the rod guide.

Most rod guides today are manufactured from a plastic material. Rod guides may be secured in various ways to the sucker rod. In one application, the rod guide is molded onto the sucker rod, and is thus rigid with the sucker rod due to the molding process.

For many applications, a rod guide provided with spiraling vanes is preferred over a straight or slanted vane guide, since more of the circumference of the tubing may be cleaned by a single spiraling guide compared to a single straight-vane guide in a reciprocating rod application. Spiraling rod guides do, however, cause high fluid drag forces to fluid passing by the rod guide and to the surface.

U.S. Pat. No. 5,277,254 discloses a helical rod guide for use with a progressing cavity pump rod. The helical guide may employ either one or two lead vanes. U.S. Pat. No. 6,182,754 discloses a helical scraper for a reciprocating sucker rod. Each of two vanes extends 180°about the body, with the ends of a flow channel between the vanes being parallel to the body of the sucker rod. U.S. Pat. No. 6,439,311 discloses a method of retarding sand buildup by employing helical vanes which are affixed to connective rods by shrink couplings. Other patents of interest include U.S. Pat. Nos. 5,660,534, 5,941,312, 6,065,537, 6,290,475, and 6,484,882, and Canadian Patents 2,260,710 and 2,291,394.

The disadvantages of the prior art are overcome by the present invention, and an improved rod guide and method of molding a rod guide are hereinafter disclosed.

SUMMARY OF THE INVENTION

In one embodiment, the rod guide for positioning on a sucker rod includes a sleeve-shaped guide body and two or more vanes each extending radially outward from the sleeve-shaped body. Each vane spirals about the body and defines a flow path between circumferentially spaced vanes. Each vane has a forward portion spiraling in a forward direction, and a backward portion spiraling in a backward direction rotatably opposite the forward direction.

In one embodiment, the rod guide includes a plastic material sleeve-shaped guide body, and the forward and backward portions meet adjacent a middle region of the guide body to form an axially elongate and continuous vane. The rod guide may be molded by engaging first and second molds to form a radially inner chamber within the engaged molds to define a sleeve-shaped guide body, with the first and second molds forming a radially outer chamber extending radially outward from and in communication with the inner chamber and defining one or more spiral vanes. Each vane has a forward portion spiraling in a forward direction and a backward portion spiraling in a backward direction rotatably opposite the forward direction.

These and further features and advantages of the present invention will become apparent from the following detailed description, wherein reference is made to the figures in the accompanying drawings.

DESCRIPTION OF THE PREFERRED EMBODIMENTS

Figure 1:
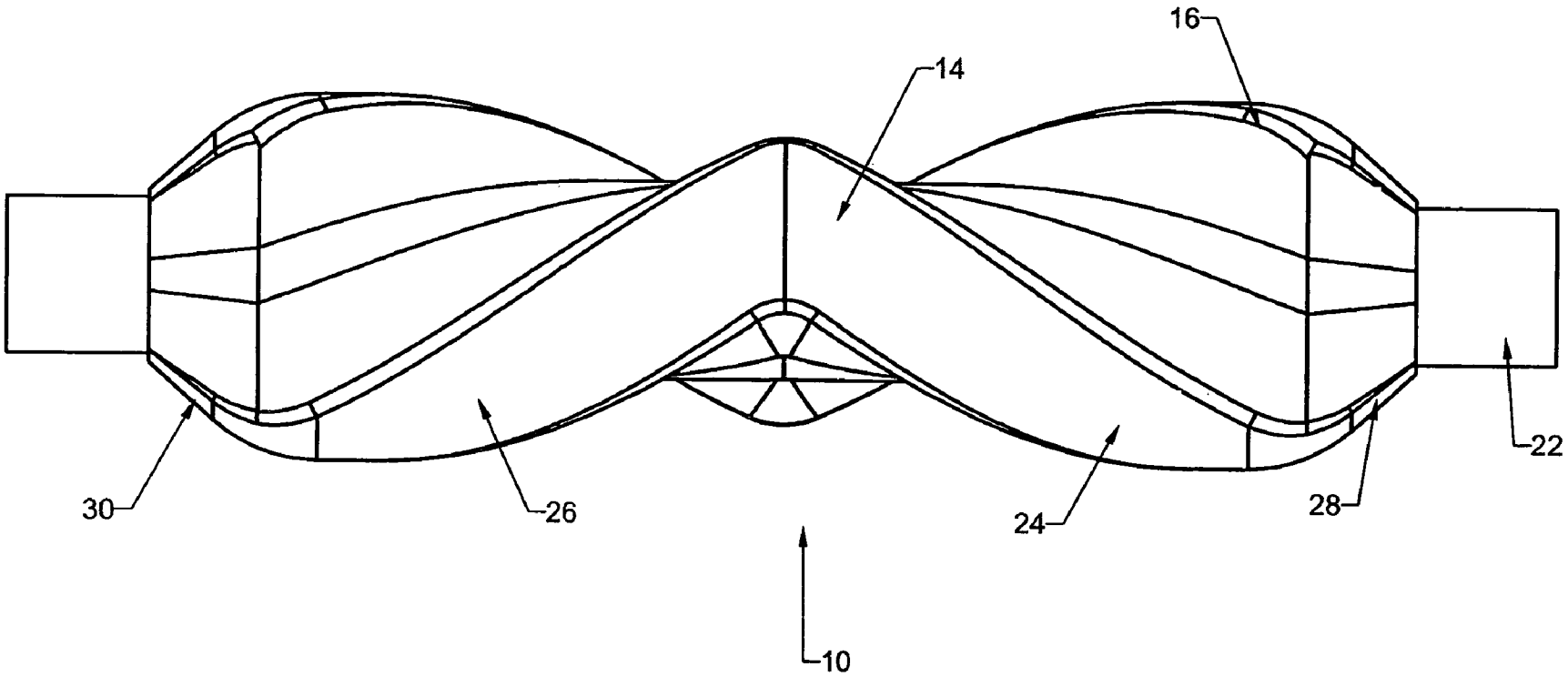
FIG. 1 is a pictorial view of a suitable rod guide molded on a sucker rod.
Figure 3:
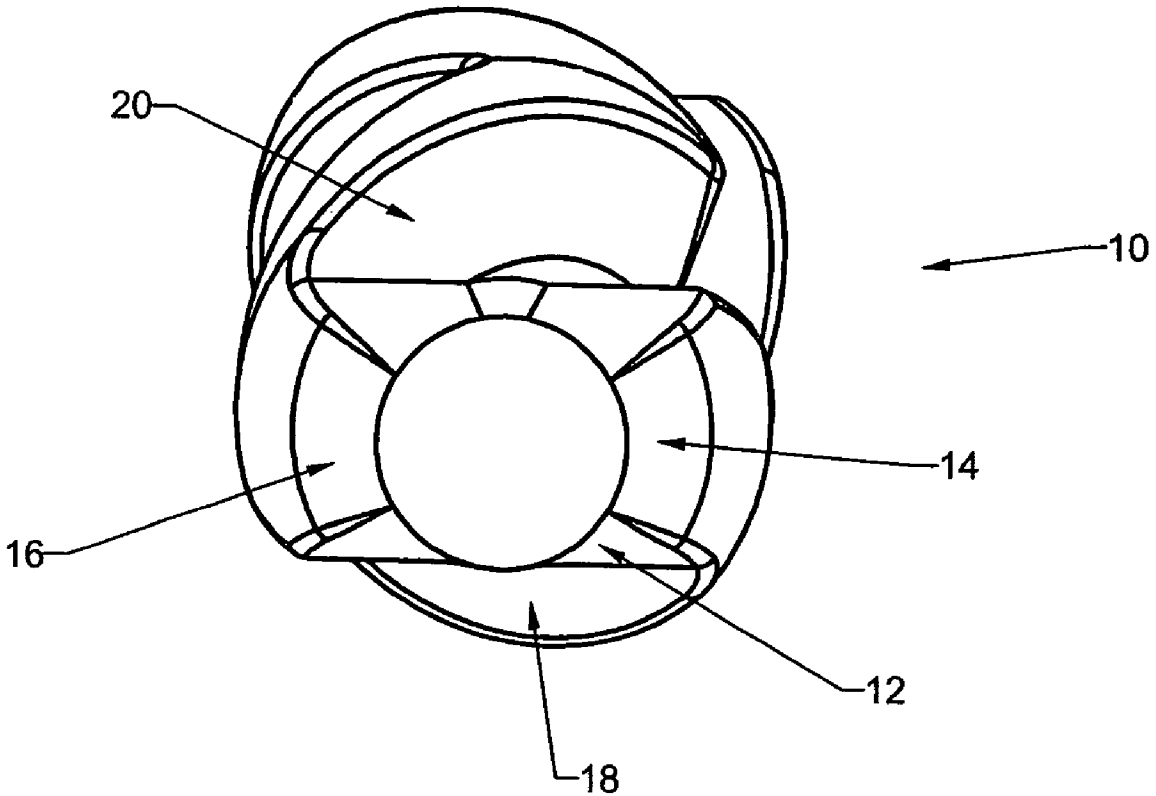
FIG. 3 is a canted top view of the rod guide shown in FIGS. 1 and 2.

FIG. 1 depicts a plastic material rod guide 10 according to this invention. Referring briefly to FIG. 3, the rod guide 10 includes a generally sleeve-shaped guide body 12 for positioning on a sucker rod, and two or more vanes 14, 16 each extending radially outward from the sleeve-shaped body 12, with each vane spiraling about the guide body and defining a fluid flow path 18, 20 between circumferentially spaced vanes. As shown in FIG. 1, the rod guide may be of a molded one-piece construction fixed to a rod 22 during the molding process, in which case the rod guide is well suited for use with a reciprocating rod to clean the interior of production tubing. If desired, a sucker rod rotator may be used to slowly rotate the sucker rod and thus the guide 10 with respect to the tubing string during use. In another embodiment, the rod guide 10 may be mounted on the sucker rod 10, which rotates to drive a progressive cavity pump, with the rotating rod guide engaging the interior of the tubing string.

As shown in FIG. 1, each vane has a forward portion 24 spiraling in a forward direction, and a backward portion 26 spiraling in a backward direction rotatably opposite the forward direction. The terms "forward" and "backward" are not intended to be indicative of direction, and only indicate that one portion of the vane spirals in a rotatably opposite direction from the other portion. Looking at the rod guide shown in FIG. 1 and moving downward along the guide, the forward portion may be the clockwise direction and the backward portion the counterclockwise direction, but the forward portion could alternatively be the counterclockwise direction and the backward portion the clockwise direction.

Referring still to FIG. 1, the forward and backward portions 24, 26 each meet adjacent a middle region of the guide body to form an axially elongate and continuous vane, and in the disclosed embodiment these portions meet at substantially an axial center of the sleeve-shaped body. In order to minimize the flow losses of fluid passing by the rod guide and between the vanes, the forward and backward portions are substantially mirror images of one another and have substantially the same spiral taper and substantially the same axial length. Each end 28, 30 of each vane is tapered radially inward toward the sleeve-shaped guide body, as shown. The end, 28, 30 may define side surfaces extending radially inward toward the center of the guide in a direction moving axially toward the extreme end of the guide, thereby facilitating molding of the guide.

Figure 2:
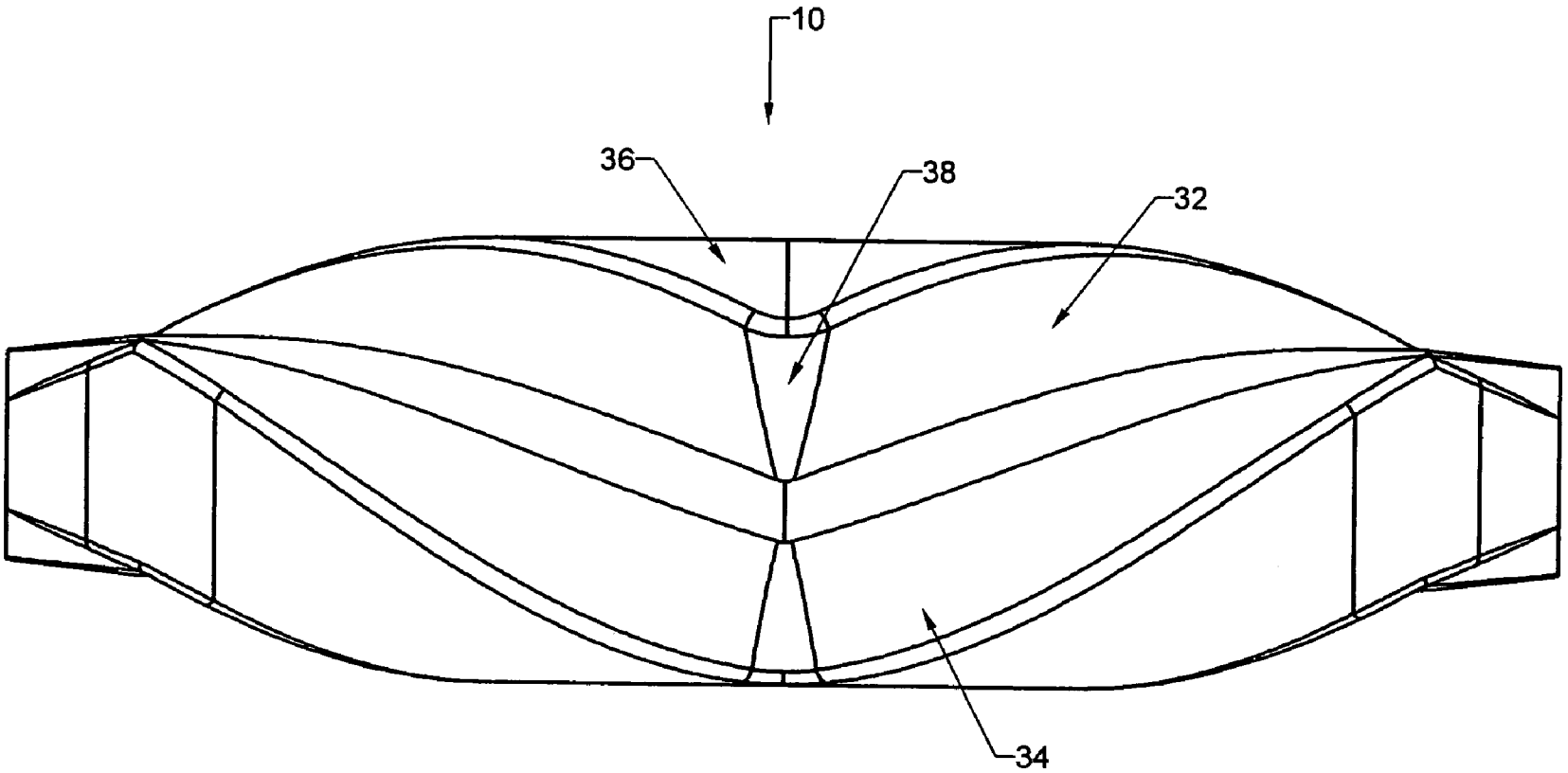
FIG. 2 is another view of the rod guide shown in FIG. 1.

In a preferred embodiment, each vane 14, 16 has a left-side surface 32 as shown in FIG. 2, a right-side surface 34 which is substantially parallel to the left-side surface of a respective vane, and the radially exterior surface 36 which extends between the left-side and the right-side surfaces. Each of these surfaces is a substantially curved planar surface, and each vane has a circumferential width of from 30° to 60°. Each vane also extends circumferentially about the guide body from 130° to 220° to provide a substantial circumferential area for cleaning the production tubing string while retaining a relatively large flow area for fluid passage by the rod guide.

By providing the rod guide with both a forward spiraling portion and a backward spiraling portion, fluid drag through the rod guide is minimized compared to an embodiment which continued to spiral the vanes along the length of the guide in a single direction. Also, a rounded transition region 38 is provided between the forward directed portion and the backward directed portion of each vane and further reduces fluid drag. A circumferential width of each flow passage is from about 120° to about 150°.

Although the rod guide as disclosed herein is well suited for use on a reciprocating rod string, the rod guide may also be used on a rotating rod string for driving a PC pump. For this latter application, the guide may be fixedly molded to the rod string as for the reciprocating rod application. The guide provides a large bearing area, which is the exterior surface of the vanes, for engaging the interior of the tubing string to provide for long life. Although the guide as disclosed herein for preferred applications may have two generally radially opposing vanes, the guide may be provided with one or more vanes, with each vane having a forward portion spiraling in a forward direction and a backward portion spiraling in a backward direction rotatably opposite the forward direction. If three or more vanes are provided, each of the vanes would generally be positioned at consistent intervals about the circumference of the sleeve-shaped guide body, so that three vanes would be spaced at substantially 120° intervals.

The rod guide may be molded for fixing on a sucker rod utilizing first and second molds which engage to form a radially inner chamber in the engaged molds defining the sleeve-shaped guide body. The first and second molds may also form a radially outer chamber extending radially outward from and in communication with the inner chamber, and define the one or more spiraling vanes each having a forward portion spiraling in a forward direction and a backward portion spiraling in a backward direction rotatably opposite the forward direction.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A method of forming and securing a rod guide on a sucker rod, comprising:

injection molding a guide body on the sucker rod to secure the rod guide on the sucker rod, the guide body including a sleeve-shaped plastic guide body, and the rod guide including two or more plastic material vanes each extending radially outward from the sleeve-shaped guide body, each vane spiraling about the guide body and defining a flow path between circumferentially spaced vanes;

each vane having a forward portion spiraling in a forward direction, and a backward portion spiraling in a backward direction rotatably opposite the forward direction; and each vane extending circumferentially about the guide body from 130° to 220° within a plane perpendicular to a central axis of the guide body.

2. A method as defined in claim 1, wherein each vane has a circumferential width of from 30 to 60°.

3. A method as defined in claim 1, further comprising:

forming a rounded transition region between the forward directed portion and the backward directed portion of each vane.

4. A method as defined in claim 1, wherein an end of each vane is tapered radially inward toward the sleeve-shaped guide body.

5. A method as defined in claim 1, wherein each of a left side, a right side, and a radially exterior surfaces of each vane form a substantially curved planar surface.

6. A method as defined in claim 1, wherein the guide body circumferentially surrounds the sucker rod within a plane perpendicular to a central axis of the rod guide.

7. A method of forming and securing a rod guide on a sucker rod, comprising:

injection molding a guide body on the sucker rod to secure the rod guide on the sucker rod, the guide body including a sleeve-shaped plastic guide body, and the rod guide including two or more plastic material vanes each extending radially outward from the sleeve-shaped guide body, each vane spiraling about the guide body and defining a flow path between circumferentially spaced vanes, the guide body circumferentially surrounding the sucker rod within a plane perpendicular to a central axis of the rod guide;

each vane having a forward portion spiraling in a forward direction, and a backward portion spiraling in a backward direction rotatably opposite the forward direction; and each vane extending circumferentially about the guide body from 130° to 220° within a plane perpendicular to a central axis of the guide body, and having a circumferential width of from 30 to 60°.

8. A method as defined in claim 7, further comprising:

forming a rounded transition region between the forward directed portion and the backward directed portion of each vane.

9. A method as defined in claim 7, wherein an end of each vane is tapered radially inward toward the sleeve-shaped guide body.

10. A method as defined in claim 7, wherein each of a left side, a right side, and a radially exterior surfaces of each vane form a substantially curved planar surface.

11. A method of forming and securing a rod guide on a sucker rod, comprising:

injection molding a guide body on the sucker rod to secure the rod guide on the sucker rod, the guide body including a sleeve-shaped plastic guide body, and the rod guide including two or more plastic material vanes each extending radially outward from the sleeve-shaped guide body, each vane spiraling about the guide body and defining a flow path between circumferentially spaced vanes, the guide body circumferentially surrounding the sucker rod within a plane perpendicular to a central axis of the rod guide;

each vane having a forward portion spiraling in a forward direction, and a backward portion spiraling in a backward direction rotatably opposite the forward direction; and each vane extending circumferentially about the guide body from 130° to 220° within a plane perpendicular to a central axis of the guide body, and an end of each vane being tapered radially inward toward the sleeve-shaped guide body.

12. A method as defined in claim 11, wherein each vane has a circumferential width of from 30 to 60°.

13. A method as defined in claim 11, further comprising:

forming a rounded transition region between the forward directed portion and the backward directed portion of each vane.

14. A method as defined in claim 11, wherein each of a left side, a right side, and a radially exterior surfaces of each vane form a substantially curved planar surface.

* * * * *